US007643041B2

(12) United States Patent
Tomohara

(10) Patent No.: US 7,643,041 B2
(45) Date of Patent: Jan. 5, 2010

(54) DISPLAY CONTROLLER WHICH OUTPUTS A GRAYSCALE CLOCK SIGNAL

(75) Inventor: Kiyohide Tomohara, Suwa (JP)

(73) Assignee: Seiko Epson Corporation (JP)

( * ) Notice: Subject to any disclaimer, the term of this patent is extended or adjusted under 35 U.S.C. 154(b) by 354 days.

(21) Appl. No.: 11/016,515

(22) Filed: Dec. 17, 2004

(65) Prior Publication Data

US 2005/0134614 A1 Jun. 23, 2005

(30) Foreign Application Priority Data

Dec. 19, 2003 (JP) ..... 2003-423311

(51) Int. Cl.
*G09G 5/10* (2006.01)

(52) U.S. Cl. ..... 345/690; 345/83

(58) Field of Classification Search ..... 345/112, 345/154, 589, 674, 690, 84–104, 83, 204, 345/691; 358/300, 500, 525
See application file for complete search history.

(56) References Cited

U.S. PATENT DOCUMENTS

| | | | | |
|---|---|---|---|---|
| 5,929,835 | A * | 7/1999 | Sakamoto | 345/589 |
| 6,456,414 | B1 * | 9/2002 | Dahlke et al. | 359/201 |
| 6,906,706 | B2 * | 6/2005 | Kosaka et al. | 345/211 |
| 6,947,060 | B2 * | 9/2005 | Abe | 345/691 |

FOREIGN PATENT DOCUMENTS

| | | |
|---|---|---|
| JP | 07-036405 | 2/1995 |
| JP | 07-261712 | 10/1995 |
| JP | 07-319427 | 12/1995 |
| JP | 08-095531 | 4/1996 |
| JP | 11-073159 | 3/1999 |
| JP | 2003-044015 | 2/2003 |

OTHER PUBLICATIONS

Communication from Japanese Patent Office re: related application.

* cited by examiner

*Primary Examiner*—Chanh Nguyen
*Assistant Examiner*—Pegeman Karimi
(74) *Attorney, Agent, or Firm*—Harness, Dickey & Pierce, P.L.C.

(57) ABSTRACT

A display controller which outputs a grayscale clock signal for specifying a change point of a pulse width modulated signal. The display controller includes: a grayscale clock generation section which generates a grayscale clock signal having first to Nth (N is an integer greater than one) grayscale pulses within a predetermined period starting from a reference timing; and first to Nth grayscale pulse setting registers for setting edges of the first to Nth grayscale pulses. The grayscale clock generation section sets an interval between the reference timing and an edge of the first grayscale pulse and an interval between edges of the (i−1)th grayscale pulse (2≦i≦N, i is an integer) and the ith grayscale pulse, based on values set in the first to Nth grayscale pulse setting registers, and outputs the grayscale clock signal having the first to Nth grayscale pulses.

12 Claims, 18 Drawing Sheets

FIG. 15

| XRST | CLK | XCLR | LD | E | LOAD VALUE | CURRENT | NEXT | NOTE |
|---|---|---|---|---|---|---|---|---|
| 0 | – | – | – | – | – | – | 0 | RESET |
| 1 | ↑ | 0 | – | – | – | – | 0 | COUNT STOP |
| 1 | ↑ | 1 | 1 | – | G | GCNT1 | G | SETTING VALUE LOAD |
| 1 | ↑ | 1 | 0 | 1 | G | GCNT1>0 | GCNT1-1 | COUNTDOWN |
| 1 | ↑ | 1 | 0 | 0 | G | GCNT1 | GCNT1 | HOLD |
| OTHERS | | | | | G | GCNT1 | GCNT1 | HOLD |

FIG. 16

| XRST | CLK | XCLR | LD | E | LOAD VALUE | CURRENT | NEXT | NOTE |
|---|---|---|---|---|---|---|---|---|
| 0 | – | – | – | – | – | – | 15 | RESET |
| 1 | ↑ | 0 | – | – | – | – | 15 | INITIAL VALUE LOAD |
| 1 | ↑ | 1 | 1 | – | LDVALUE | GCNT2 | LDVALUE | SETTING VALUE LOAD |
| 1 | ↑ | 1 | 0 | 1 | LDVALUE | GCNT2<15 | GCNT2+1 | COUNTUP |
| 1 | ↑ | 1 | 0 | 0 | LDVALUE | GCNT2 | GCNT2 | HOLD |
| OTHERS | | | | | LDVALUE | GCNT2 | GCNT2 | HOLD |

FIG. 17

| SIGNAL NAME | CONDITION |
|---|---|
| GCNT1LD | (CNTSTART=1 OR (GCNT2≠15 AND GCNT1=0)) AND ENB=1 |
| GCNT1_E | GCNT2≠15 AND ENB=1 |
| GCNT2LD | (CNTSTART=1 OR (GCNT1=0 AND G=0)) AND ENB=1 |
| PREGCLK | GCNT1=1 |

DISPLAY CONTROLLER WHICH OUTPUTS A GRAYSCALE CLOCK SIGNAL

Japanese Patent Application No. 2003-423311, filed on Dec. 19, 2003, is hereby incorporated by reference in its entirety.

BACKGROUND OF THE INVENTION

The present invention relates to a display controller, a display system, and a display control method.

In recent years, a display device using an electroluminescence (EL) element has attracted attention. In particular, since an organic EL panel including an EL element formed by an organic material thin film is a self-emission type, a backlight becomes unnecessary, whereby a wide viewing angle is implemented. Moreover, since the organic EL panel responds at a high speed in comparison with a liquid crystal panel, a color video display can be easily implemented using a simple configuration.

The organic EL panel is divided into a simple matrix type and an active matrix type in the same manner as the liquid crystal panel. When driving a simple matrix type organic EL panel, a grayscale control can be achieved by pulse width modulation (hereinafter abbreviated as "PWM").

However, since the manufacturing technology of the organic EL panel is immature in comparison with the manufacturing technology of the liquid crystal panel, manufacturing variation occurs to a considerable extent. This causes variation in grayscale characteristics. Therefore, even if grayscale control is performed by PWM, a desired grayscale representation generally cannot be implemented, differing from the drive of the liquid crystal panel.

When displaying a color display using the organic EL panel, a color filter may be provided in the same manner as in the liquid crystal panel. However, this results in decrease in luminance, whereby the features of the organic EL cannot be fully utilized. On the other hand, a color display can be implemented by changing the emission color by selecting an organic material. In this case, the features of the organic EL can be utilized.

However, the grayscale characteristics of R, G, and B color components, which are color components that make up one pixel, vary to a large extent. Moreover, there is a significant difference in luminance between the color components of the organic EL element.

BRIEF SUMMARY OF THE INVENTION

According to a first aspect of the present invention, there is provided a display controller which outputs a grayscale clock signal for specifying a change point of a pulse width modulated signal, the display controller comprising:

a grayscale clock generation section which generates a grayscale clock signal having first to Nth (N is an integer greater than one) grayscale pulses within a predetermined period starting from a reference timing; and first to Nth grayscale pulse setting registers for setting edges of the first to Nth grayscale pulses, wherein the grayscale clock generation section sets an interval between the reference timing and an edge of the first grayscale pulse and an interval between edges of the (i−1)th grayscale pulse ($2 \leqq i \leqq N$, i is an integer) and the ith grayscale pulse, based on values set in the first to Nth grayscale pulse setting registers, and outputs the grayscale clock signal having the first to Nth grayscale pulses.

According to a second aspect of the present invention, there is provided a display system, comprising:

a display panel which includes a plurality of scan lines, a plurality of data lines, and a plurality of electroluminescence elements, each of the electroluminescence elements being specified by one of the scan lines and one of the data lines;

a scan driver which scans the scan lines;

a data driver which drives the data lines based on a pulse width modulated signal; and the above-described display controller, wherein the display controller supplies the grayscale clock signal to the data driver; and wherein the data driver generates the pulse width modulated signal having a pulse width which is determined based on the number of clocks of the grayscale clock signal corresponding to grayscale data, and drives the data lines based on the pulse width modulated signal.

According to a third aspect of the present invention, there is provided a display control method using a pulse width modulated signal having a change point which is specified by a grayscale clock signal, the display control method comprising:

setting a period from a reference timing to an edge of a first grayscale pulse and a period from an edge of an (i−1)th grayscale pulse to an edge of an ith grayscale pulse ($2 \leqq i \leqq N$, i and N are integers);

generating a grayscale clock signal having first to Nth grayscale pulses within a predetermined period starting from the reference timing; and generating the pulse width modulated signal having a pulse width which is determined based on the number of clocks of the grayscale clock signal corresponding to grayscale data, and driving data lines of a display panel based on the pulse width modulated signal.

BRIEF DESCRIPTION OF THE SEVERAL VIEWS OF THE DRAWING

FIG. 15 is a truth table for an operation of the pulse width counter shown in FIG. 14.

FIG. 16 is a truth table for an operation of the grayscale counter shown in FIG. 14.

FIG. 17 is a truth table for an operation of the decoder shown in FIG. 14.

DETAILED DESCRIPTION OF THE EMBODIMENTS

Figure 1:
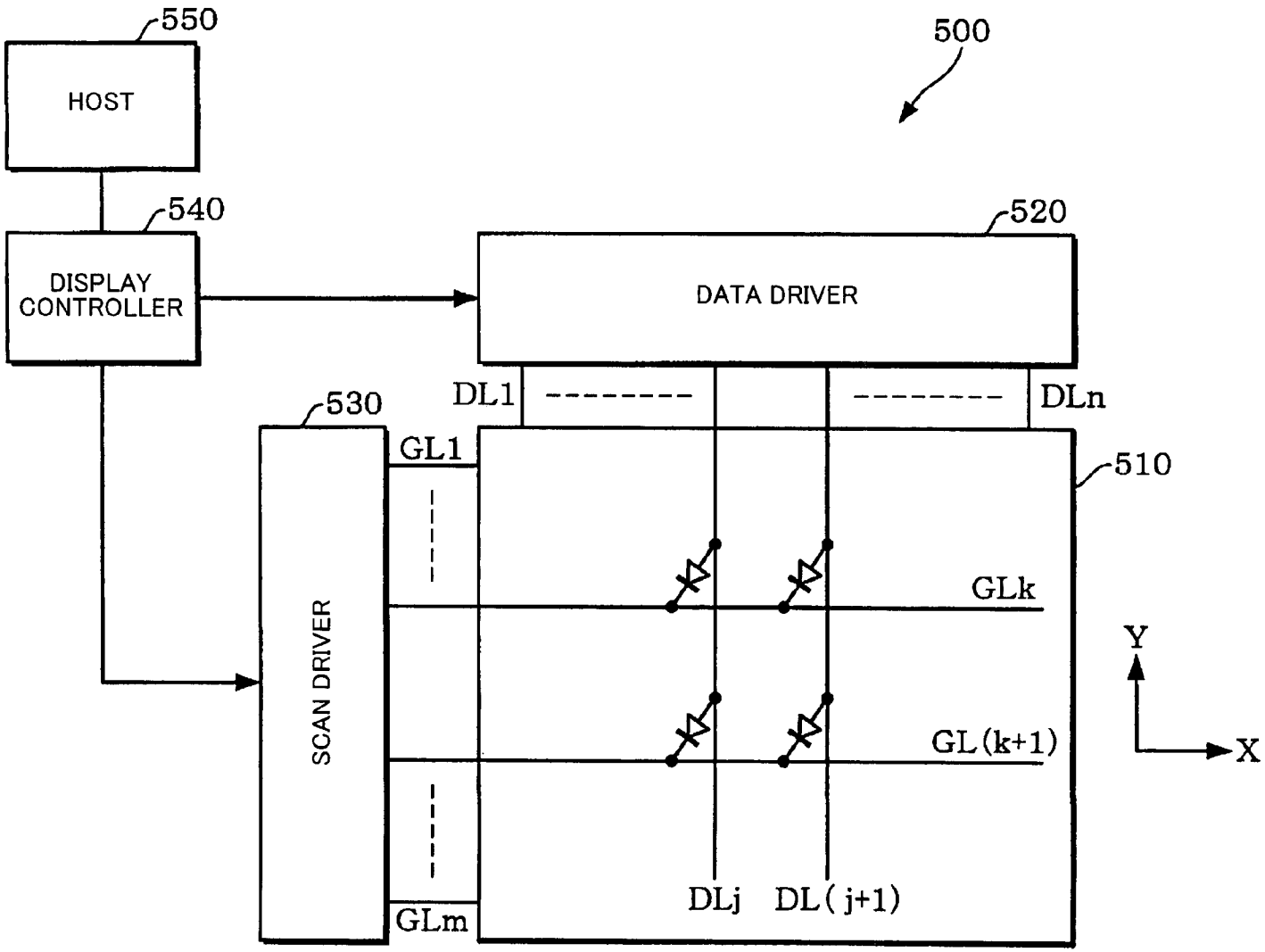
FIG. 1 is a block diagram showing the configuration of a display system according to one embodiment of the present invention.

The embodiments of the present invention has been achieved in view of the above-described problems, and the embodiments may provide a display controller, a display system, and a display control method enabling fine gamma correction to implement a desired grayscale representation when performing grayscale control of an organic EL panel, for example.

The embodiments of the present invention may also provide a display controller, a display system, and a display control method enabling gamma correction of each color component to implement a desired grayscale representation when performing grayscale control of an organic EL panel, for example.

According to one embodiment of the present invention, there is provided a display controller which outputs a grayscale clock signal for specifying a change point of a pulse width modulated signal, the display controller comprising:

a grayscale clock generation section which generates a grayscale clock signal having first to Nth (N is an integer greater than one) grayscale pulses within a predetermined period starting from a reference timing; and first to Nth grayscale pulse setting registers for setting edges of the first to Nth grayscale pulses, wherein the grayscale clock generation section sets an interval between the reference timing and an edge of the first grayscale pulse and an interval between edges of the (i−1)th grayscale pulse ($2 \leqq i \leqq N$, i is an integer) and the ith grayscale pulse, based on values set in the first to Nth grayscale pulse setting registers, and outputs the grayscale clock signal having the first to Nth grayscale pulses.

Since a timing of an edge of each grayscale pulse of the grayscale clock signal for specifying a change point of the pulse width modulated signal can be individually set, gamma correction which corrects the grayscale characteristics of the display panel can be finely performed. Therefore, a desired grayscale representation can be implemented even if the grayscale characteristics vary due to considerable manufacturing variation such as in an organic EL panel whose manufacturing technology is immature in comparison with the manufacturing technology of a liquid crystal panel.

The display controller may further comprise a blanking adjustment signal generation section which generates a blanking adjustment signal for setting a blanking period in which a pulse of a horizontal synchronization signal is output, wherein the predetermined period starts from a change timing of the blanking adjustment signal and ends at a next change timing of the blanking adjustment signal.

Since a period in which the grayscale clock signal can be output can be adjusted by adjusting the blanking period, occurrence of a flicker can be prevented and the luminance can be adjusted to be suitable for the size of the display panel and the like. Moreover, since a grayscale pulse of the grayscale clock signal can be set as an absolute value within a period in which the grayscale clock signal can be output, a desired grayscale representation can be facilitated.

In the display controller, the grayscale clock generation section and the first to Nth grayscale pulse setting registers may be provided for each color component which makes up one pixel; and the grayscale clock generation section for each color component may set an interval between the reference timing and an edge of the first grayscale pulse for each color component and an interval between edges of the (i−1)th grayscale pulse and the ith grayscale pulse for each color component, based on values set in the first to Nth grayscale pulse setting registers for each color component, and may output the grayscale clock signal having the first to Nth grayscale pulses.

This makes it possible to implement fine gamma correction for each color component even if there is a significant difference in luminance between the color components, whereby a desired grayscale representation can be easily obtained.

In the display controller, the grayscale clock generation section may omit generation of the (p+1)th to Nth grayscale pulses ($1 \leqq p \leqq N-1$, p is an integer) when a value set in the pth grayscale pulse setting register is a predetermined value, on condition that: the first grayscale pulse is output so that an edge of the first grayscale pulse occurs when a period starting from the reference timing and corresponding to a value set in the first grayscale pulse setting register has elapsed, and the ith grayscale pulse is output so that an edge of the ith grayscale pulse occurs when a period starting from an edge of the (i−1)th grayscale pulse and corresponding to a value set in the ith grayscale pulse setting register has elapsed.

This makes it possible to provide a display controller which can be easily applied to the case where it suffices that the number of grayscales be smaller.

According to one embodiment of the present invention, there is provided a display system, comprising:

a display panel which includes a plurality of scan lines, a plurality of data lines, and a plurality of electroluminescence elements, each of the electroluminescence elements being specified by one of the scan lines and one of the data lines;

a scan driver which scans the scan lines;

a data driver which drives the data lines based on a pulse width modulated signal; and the above-described display controller, wherein the display controller supplies the grayscale clock signal to the data driver; and wherein the data driver generates the pulse width modulated signal having a pulse width which is determined based on the number of clocks of the grayscale clock signal corresponding to grayscale data, and drives the data lines based on the pulse width modulated signal.

This makes it possible to provide a display system which enables fine gamma correction for an organic EL panel and implements a desired grayscale representation.

According to one embodiment of the present invention, there is provided a display control method using a pulse width modulated signal having a change point which is specified by a grayscale clock signal, the display control method comprising:

setting a period from a reference timing to an edge of a first grayscale pulse and a period from an edge of an (i−1)th grayscale pulse to an edge of an ith grayscale pulse ($2 \leqq i \leqq N$, i and N are integers);

generating a grayscale clock signal having first to Nth grayscale pulses within a predetermined period starting from the reference timing; and generating the pulse width modulated signal having a pulse width which is determined based on the number of clocks of the grayscale clock signal corresponding to grayscale data, and driving data lines of a display panel based on the pulse width modulated signal.

In the display control method, the predetermined period may start from a change timing of a blanking adjustment signal for setting a blanking period in which a pulse of a horizontal synchronization signal is output and may end at a next change timing of the blanking adjustment signal.

The display control method may comprise:

generating the grayscale clock signal by setting an interval between the reference timing and an edge of the first grayscale pulse and an interval between edges of the (i−1)th grayscale pulse and the ith grayscale pulse, for each color component which makes up one pixel; and generating the pulse width modulated signal having a pulse width which is determined based on the number of clocks of the grayscale clock signal corresponding to the grayscale data for each of the color components.

In the display control method, generation of the (p+1)th to Nth grayscale pulses ($1 \leqq p \leqq N-1$, p is an integer) may be omitted when a value set in the pth grayscale pulse setting register is a predetermined value, on condition that: the first grayscale pulse is output based on the reference timing and the ith grayscale pulse is output based on an edge of the (i−1)th grayscale pulse, according to values set in first to Nth grayscale pulse setting registers.

These embodiments of the present invention will be described in detail with reference to the drawings. Note that the embodiments described below do not in any way limit the scope of the invention laid out in the claims herein. In addition, not all of the elements of the embodiments described below should be taken as essential requirements of the present invention.

1. Display System

FIG. 1 is a block diagram showing the configuration of a display system according to one embodiment of the invention.

A display system 500 includes an organic EL panel (display panel in a broad sense) 510, a data driver 520, a scan driver 530, and a display controller 540. The display system 500 does not necessarily include all of these circuit blocks. The display system 500 may have a configuration in which some of the circuit blocks are omitted. The display system 500 may be configured to include a host 550.

The organic EL panel 510 is a simple matrix type. FIG. 1 shows an electrical configuration of the organic EL panel 510. Specifically, the organic EL panel 510 includes a plurality of scan lines (cathodes in a narrow sense), a plurality of data lines (anodes in a narrow sense), and an organic EL element connected with the scan line and the data line.

In more detail, the organic EL panel is formed on a glass substrate. A plurality of data lines DL1 to DLn (n is an integer greater than one), arranged in the direction X shown in FIG. 1 and extending in the direction Y, are formed on the glass substrate. A plurality of scan lines GL1 to GLm (m is an integer greater than one), arranged in the direction Y shown in FIG. 1 and extending in the direction X, are formed on the glass substrate so as to intersect the data lines. When one pixel is formed by three color components consisting of an R component, a G component, and a B component, a plurality of sets of data lines, each set consisting of the R component data line, the G component data line, and the B component data line, are arranged in the organic EL panel 510.

The organic EL element is formed at a position corresponding to the intersecting point of the data line DLj ($1 \leqq j \leqq n$, j is an integer) and the scan line GLk ($1 \leqq k \leqq m$, k is an integer).

Figure 2:
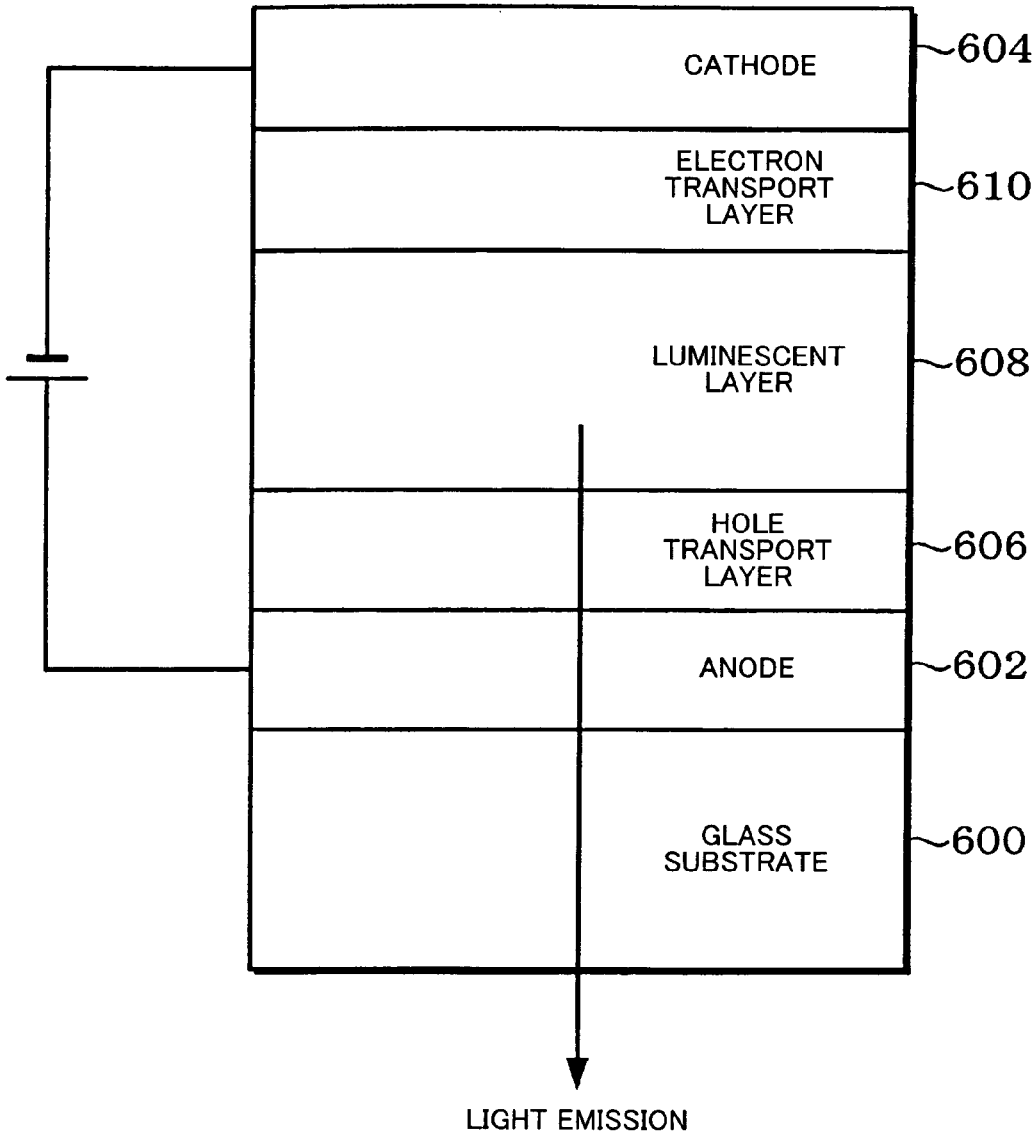
FIG. 2 is a diagram for illustrating an organic EL element.

FIG. 2 illustrates the organic EL element.

In the organic EL element, a transparent electrode (indium thin oxide (ITO), for example) which becomes an anode 602 provided as the data line is formed on a glass substrate 600. A cathode 604 provided as the scan line is formed above the anode 602. An organic layer including a luminescent layer and the like is formed between the anode 602 and the cathode 604.

The organic layer includes a hole transport layer 606 formed on the upper surface of the anode 602, a luminescent layer 608 formed on the upper surface of the hole transport layer 606, and an electron transport layer 610 formed between the luminescent layer 608 and the cathode 604.

A hole from the anode 602 and an electron from the cathode 604 recombine in the luminescent layer 608 by applying a potential difference between the data line and the scan line, specifically, by applying a potential difference between the anode 602 and the cathode 604. The molecules of the luminescent layer 608 are excited by the energy thus generated, and the energy released when the molecules return to the ground state becomes light. The light passes through the anode 602 formed of the transparent electrode and the glass substrate 600.

In FIG. 1, the data driver 520 drives the data line based on grayscale data. The data driver 520 generates a PWM signal having a pulse width corresponding to the grayscale data, and drives each data line based on the PWM signal.

The scan driver 530 sequentially selects the scan lines. As a result, current flows through the organic EL element connected with the selected scan line and the data line which intersects the scan line, whereby light is emitted.

The display controller 540 controls the data driver 520 and the scan driver 530 according to the content set by a host 550 such as a central processing unit (CPU). In more detail, the display controller 540 sets an operation mode of the data driver 520, for example, and supplies a vertical synchronization signal VD, a horizontal synchronization signal LP, a grayscale clock signal GCLK (R component grayscale signal GCLKR, G component grayscale clock signal GCLKG, and B component grayscale clock signal GCLKB) for generating the PWM signal, a dot clock signal DCLK, a disable signal DIS (blanking adjustment signal in a broad sense), and grayscale data D to the data driver 520 which are internally generated. A vertical scan period is specified by the vertical synchronization signal VD. A horizontal scan period is specified by the horizontal synchronization signal LP.

Some or all of the data driver 520, the scan driver 530, and the display controller 540 may be formed on the organic EL panel 510.

1.1 Data Line Driver Circuit

Figure 3:
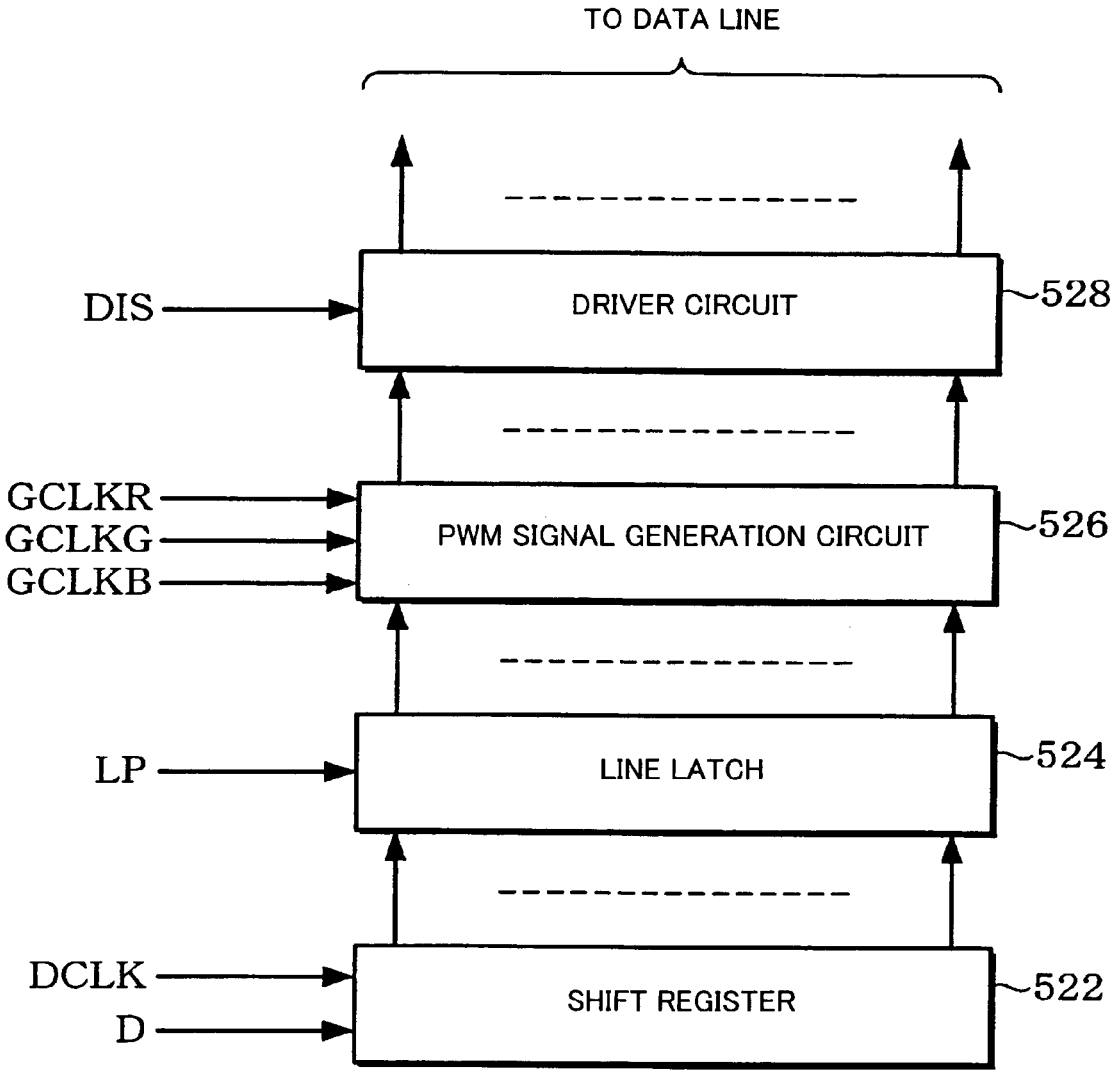
FIG. 3 is a block diagram showing the data driver shown in FIG. 1.

FIG. 3 shows the configuration the data driver 520 shown in FIG. 1.

The data driver 520 includes a shift register 522, a line latch 524, a PWM signal generation circuit 526, and a driver circuit 528.

The shift register 522 includes a plurality of flip-flops, each flip-flop being provided corresponding to each data line and sequentially connected. The dot clock signal DCLK from the display controller 540 is input in common to each flip-flop.

The R component grayscale data, G component grayscale data, B component grayscale data, R component grayscale data, . . . are sequentially input to the flip-flop in the first stage of the shift register 522 from the display controller 540 in four bit units in synchronization with the dot clock signal DCLK, for example. The R component grayscale data is data for driving the R component data line. The G component grayscale data is data for driving the G component data line. The B component grayscale data is data for driving the B component data line. The shift register 522 receives the grayscale data while shifting the grayscale data in synchronization with the dot clock signal DCLK.

The line latch 524 latches the grayscale data in one horizontal scan unit received by the shift register 522 in synchronization with the horizontal synchronization signal LP supplied from the display controller 540.

The PWM signal generation circuit 526 generates the PWM signal for driving each data line. In more detail, the PWM signal generation circuit 526 generates the PWM signal whose change point is specified by the grayscale clock signal based on the grayscale data corresponding to the data line. The PWM signal has a pulse width in the number of grayscale clock signals GCLK corresponding to the grayscale data. The PWM signal generation circuit 526 generates a PWM signal PWMR for the R component data line using an R component grayscale clock signal GCLKR and the R component grayscale data received corresponding to the data line. The PWM signal generation circuit 526 generates a PWM signal PWMG for the G component data line using a G component grayscale clock signal GCLKG and the G component grayscale data received corresponding to the data line. The PWM signal generation circuit 526 generates a PWM signal PWMB for the B component data line using a B component grayscale clock signal GCLKB and the B component grayscale data received corresponding to the data line.

The driver circuit 528 drives each data line based on the PWM signal generated by the PWM signal generation circuit 526. The disable signal DIS from the display controller 540 is input to the driver circuit 528. A horizontal display period within the horizontal scan period specified by the horizontal synchronization signal LP is specified by the disable signal DIS. The horizontal display period is a period which starts at the falling edge of the disable signal DIS and ends at the rising edge of the next disable signal DIS. A pulse of the horizontal synchronization signal LP is output in a period in which the disable signal DIS is at the H level.

The driver circuit 528 connects the data line with a ground potential when the disable signal DIS is at the H level, and supplies a predetermined current to each data line for a period corresponding to the pulse width of the PWM signal when the disable signal DIS is at the L level.

In the data driver 520, the data line can be prevented from being driven by the grayscale data in the middle of rewriting by latching the grayscale data in the next horizontal scan period in the line latch 524 when the disable signal DIS is at the H level.

1.2 Scan Driver

Figure 4:
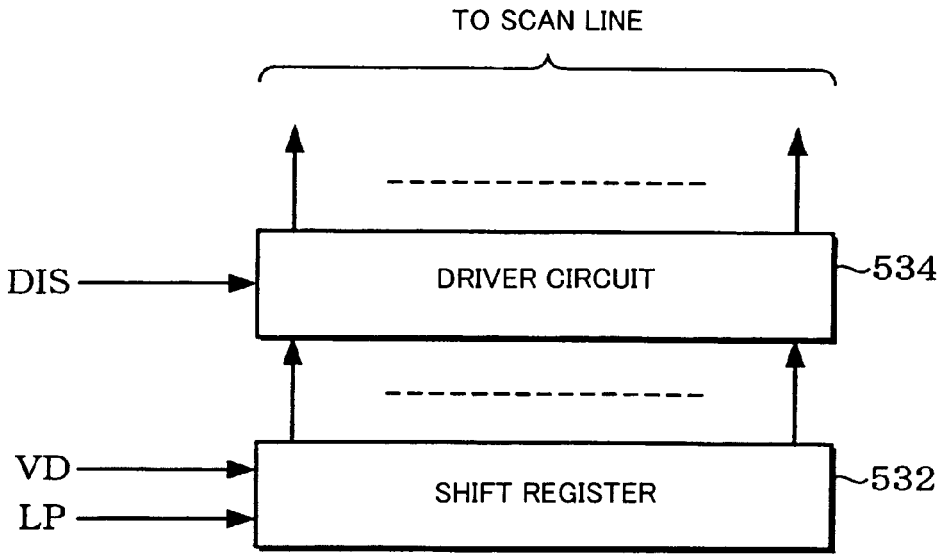
FIG. 4 is a block diagram showing the scan driver shown in FIG. 1.

FIG. 4 shows the configuration of the scan driver 530 shown in FIG. 1.

The scan driver 530 includes a shift register 532 and a driver circuit 534.

The shift register 532 includes a plurality of flip-flops, each flip-flop being provided corresponding to each scan line and sequentially connected. The horizontal synchronization signal LP from the display controller 540 is input in common to each flip-flop. The vertical synchronization signal VD from the display controller 540 is input to the flip-flop in the first stage of the shift register 532. The shift register 532 shifts the pulse of the vertical synchronization signal VD in synchronization with the horizontal synchronization signal LP.

The driver circuit 534 sequentially outputs the select pulse to each scan line based on the output from each flip-flop of the shift register 532. The disable signal DIS from the display controller 540 is input to the driver circuit 534. The driver circuit 534 connects all the scan lines with the ground potential when the disable signal DIS is at the H level, and connects only the selected scan line with the ground potential and connects the remaining scan lines with a predetermined potential when the disable signal DIS is at the L level.

1.3 Discharging Operation

Figure 5:
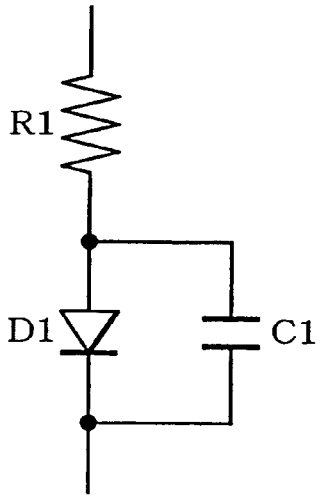
FIG. 5 is an electrical equivalent circuit diagram showing an organic EL element.

FIG. 5 shows an electrical equivalent circuit diagram of the organic EL element.

The organic EL element is considered to be equivalent to a configuration in which a resistance component R1 and a diode D1 are connected in series and which includes a parasitic capacitor C1 connected in parallel with the diode D1. The parasitic capacitor C1 is considered to be a capacitance component which corresponds to a depletion layer formed at the junction surface when a potential difference is applied between the anode 602 and the cathode 604. As described above, the organic EL element is considered to be a capacitive load.

Therefore, in the display system 500, the influence of the previous horizontal scan period can be eliminated by performing the discharging operation of the organic EL element of the organic EL panel 510 using the disable signal DIS.

Figure 6:
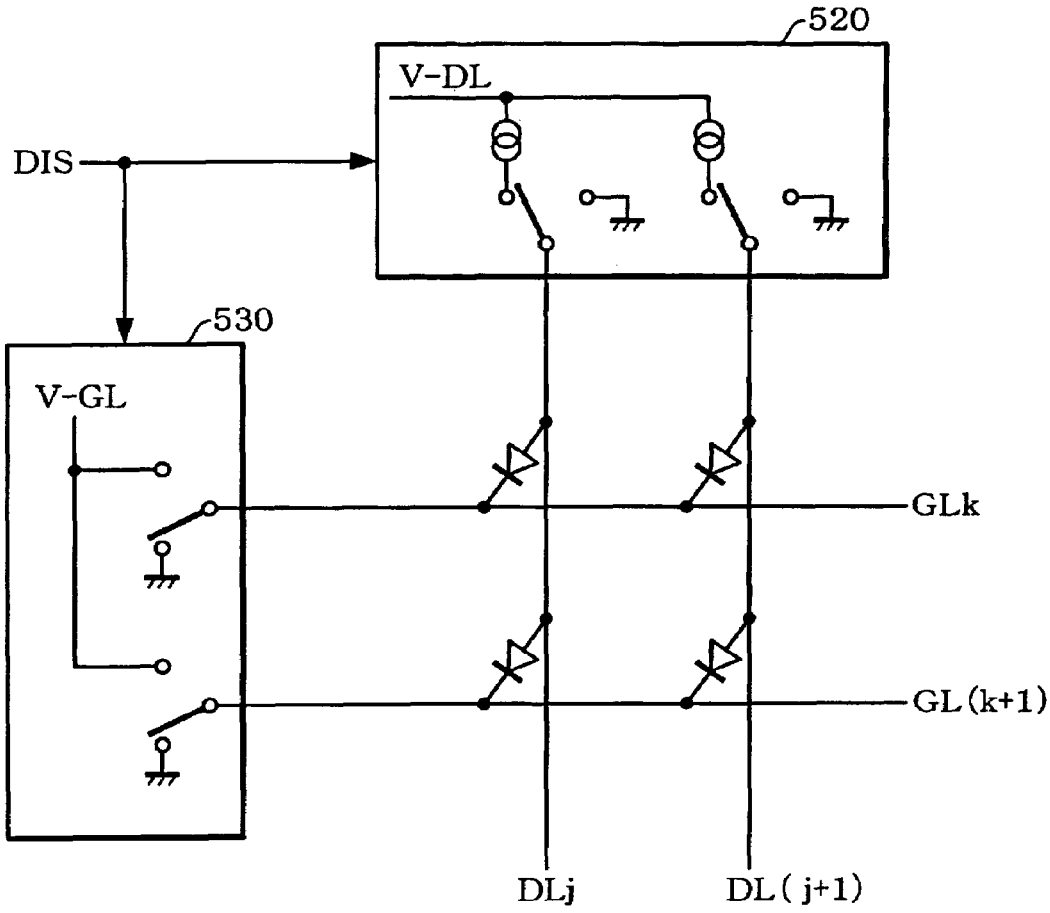
FIG. 6 is illustrative of discharging operation.

FIG. 6 is a diagram for illustrating the discharging operation. Note that components corresponding to those in the display system of FIG. 1 are denoted by the same reference numbers.

When the disable signal DIS is at the L level, the scan driver 530 sets only the selected scan line at the ground potential and connects the remaining scan lines with a potential V-GL. The data driver 520 supplies a predetermined current to the data line for a period of the pulse width corresponding to each PWM signal. As a result, a current flows through the organic EL element connected with the selected scan line.

When the disable signal DIS is at the H level, the potentials on both ends of each organic EL element become equal by connecting all the scan lines with the ground potential and connecting all the data lines with the ground potential, whereby the organic EL elements can be discharged.

Occurrence of a flicker depending on the type and manufacturing variation of the organic EL panel can be prevented or the luminance can be adjusted by adjusting the length of the horizontal display period within the horizontal scan period. Since the blanking period can be adjusted by using the disable signal DIS, the disable signal DIS may be called a blanking adjustment signal.

2. Display Controller

Figure 7:
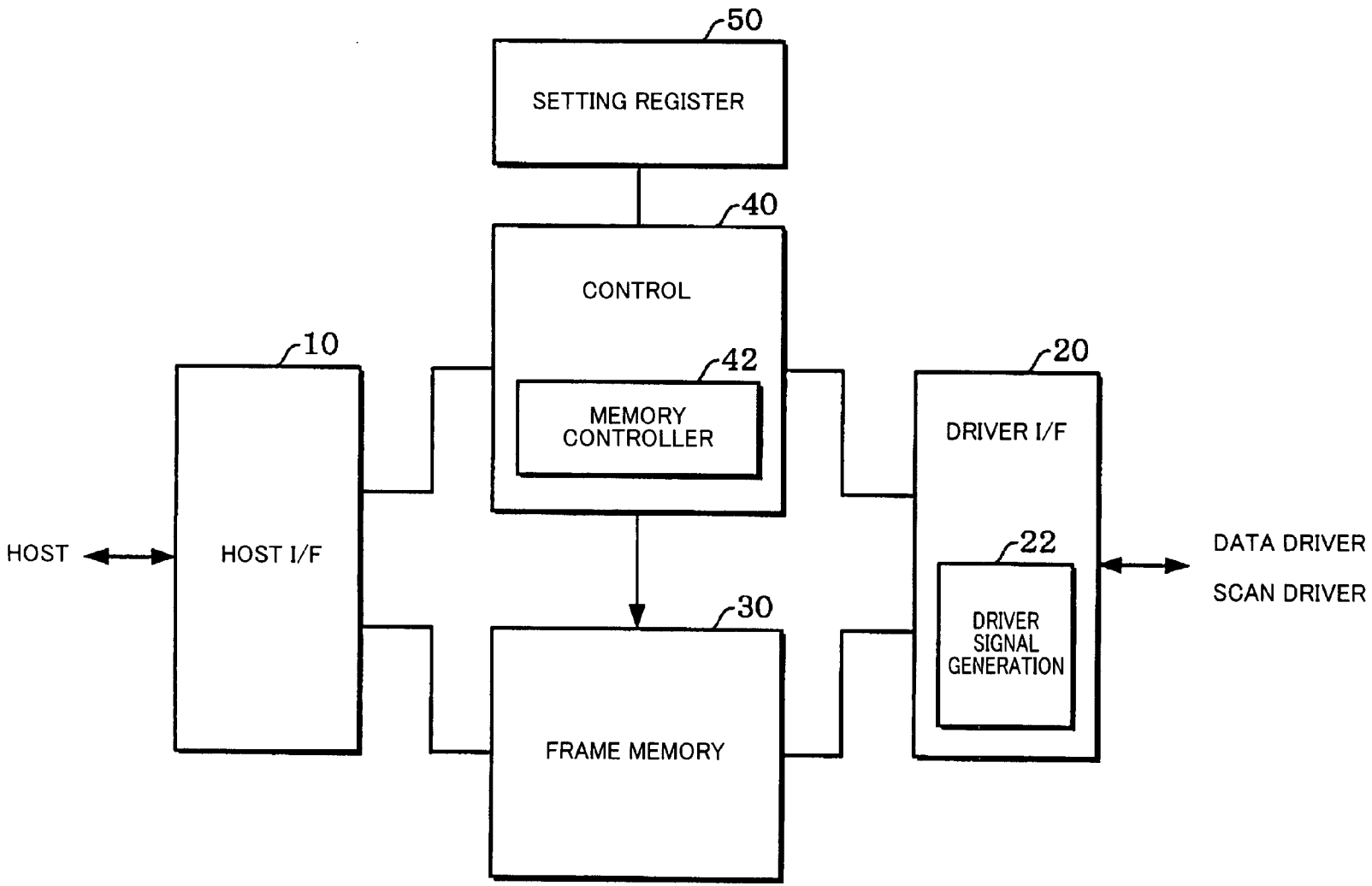
FIG. 7 is a block diagram showing a display controller according to one embodiment of the present invention.

FIG. 7 is a block diagram showing the display controller 540 in this embodiment.

The display controller 540 includes a host interface (hereinafter abbreviated as "I/F") 10, a driver I/F 20, a frame memory 30, a control section 40, and a setting register section 50.

The host I/F 10 performs interface processing with the host 550. In more detail, the host I/F 10 controls transmission/reception of data and various control signals between the display controller 540 and the host 550.

The driver I/F 20 performs interface processing with the data driver 520 and the scan driver 530. In more detail, the driver I/F 20 controls transmission/reception of data and various control signals between the display controller 540 and the data driver 520 and the scan driver 530. The driver I/F 20 includes a driver signal generation section 22 which generates various display control signals transmitted to the data driver 520 and the scan driver 530. The driver signal generation section 22 generates various display control signals based on the value set in the setting register section 50.

The frame memory 30 stores the grayscale data for one frame (for one vertical scan) supplied from the host 550 through the host I/F 10, for example. The value set in the setting register section 50 is set by the host 550 through the host I/F 10.

The control section 40 controls the host I/F 10, the driver I/F 20, the frame memory 30, and the setting register section 50.

In the display controller 540, the grayscale data is read from the frame memory 30 in a constant read cycle (every 1/160 seconds, for example), and the grayscale data is output to the data driver 520 through the driver I/F 20. Therefore, the write timing of the grayscale data into the frame memory 30 from the host 550 is asynchronous to the read timing of the grayscale data from the frame memory 30 into the data driver 520. The access control of the frame memory 30 is performed by a memory controller 42 of the control section 40.

Figure 8:
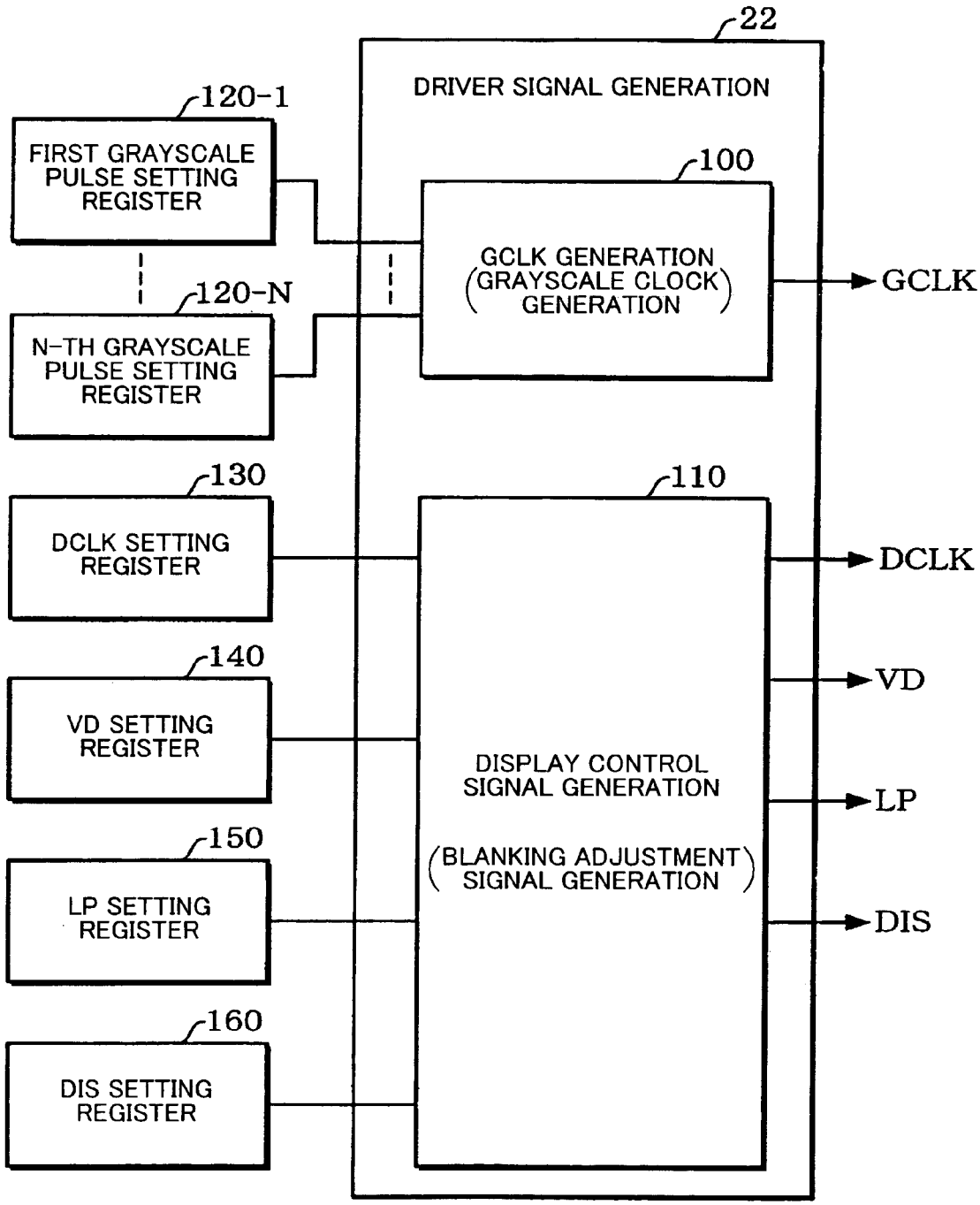
FIG. 8 is a block diagram showing a driver signal generation section.

FIG. 8 is a block diagram showing the driver signal generation section 22.

The following description illustrates the case where the driver signal generation section 22 generates the grayscale clock signal GCLK, the dot clock signal DCLK, the vertical synchronization signal VD, the horizontal synchronization signal LP, and the disable signal DIS.

The driver signal generation section 22 includes a GCLK generation section 100 (grayscale clock generation section in a broad sense) and a display control signal generation section 110. The GCLK generation section 100 generates the grayscale clock signal GCLK. The grayscale clock signal GCLK has first to Nth (N is an integer greater than one) grayscale pulses within the horizontal display period. The display control signal generation section 110 generates the dot clock signal DCLK, the vertical synchronization signal VD, the horizontal synchronization signal LP, and the disable signal DIS.

The setting register section 50 in this embodiment includes first to Nth grayscale pulse setting registers 120-1 to 120-N, a DCLK setting register 130, a VD setting register 140, an LP setting register 150, and a DIS setting register 160.

Figure 9:
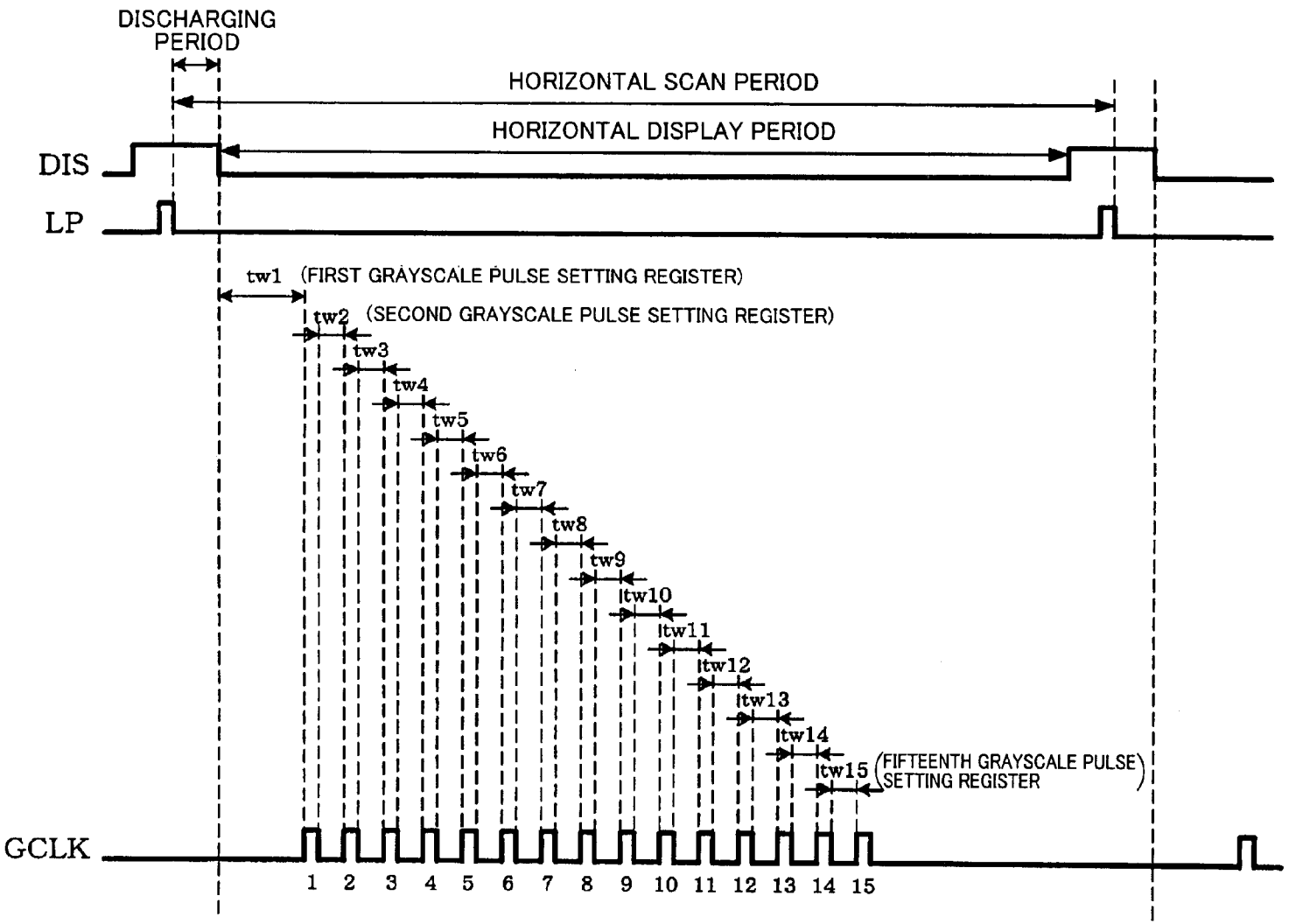
FIG. 9 is illustrative of a grayscale clock signal set by first to Nth grayscale pulse setting registers.

FIG. 9 shows the grayscale clock signal GCLK set by the first to Nth grayscale pulse setting registers 120-1 to 120-N. FIG. 9 shows the case where N is 15.

The first grayscale pulse setting register 120-1 is a register for setting an interval tw1 between a reference timing which is the starting point of the horizontal display period and the edge (rising edge or falling edge) of the first grayscale pulse. The second grayscale pulse setting register 120-2 is a register for setting an interval tw2 between the edge of the first grayscale pulse and the edge of the second grayscale pulse. Specifically, the ith ($2 \leqq i \leqq N$, i is an integer) grayscale pulse setting register is a register for setting an interval twi between the edge of the (i−1)th grayscale pulse and the edge of the ith grayscale pulse.

In FIG. 8, the GCLK generation section 100 generates the grayscale clock signal GCLK of which the interval between the reference timing which is the starting point of the horizontal display period and the edge of the first grayscale pulse and the interval between the edge of the (i−1)th grayscale pulse and the edge of the ith grayscale pulse are set based on the values set in the first to Nth grayscale pulse setting registers 120-1 to 120-N.

The DCLK setting register 130 is a register for setting the frequency, output start timing, and output end timing of the dot clock signal DCLK. The VD setting register 140 is a register for setting the output timing of the vertical synchronization signal VD. The LP setting register 150 is a register for setting the output timing of the horizontal synchronization signal LP. The DIS setting register 160 is a register for setting the rising timing, the falling timing, and the output start timing of the disable signal DIS. The display control signal generation section 110 outputs the dot clock signal DCLK based on the value set in the DCLK setting register 130. The display control signal generation section 110 outputs the vertical synchronization signal VD based on the value set in the VD setting register 140. The display control signal generation section 110 outputs the horizontal synchronization signal LP based on the value set in the LP setting register 150. The display control signal generation section 110 (blanking adjustment signal generation section in a broad sense) outputs the disable signal DIS based on the value set in the DIS setting register 160.

Figure 10:
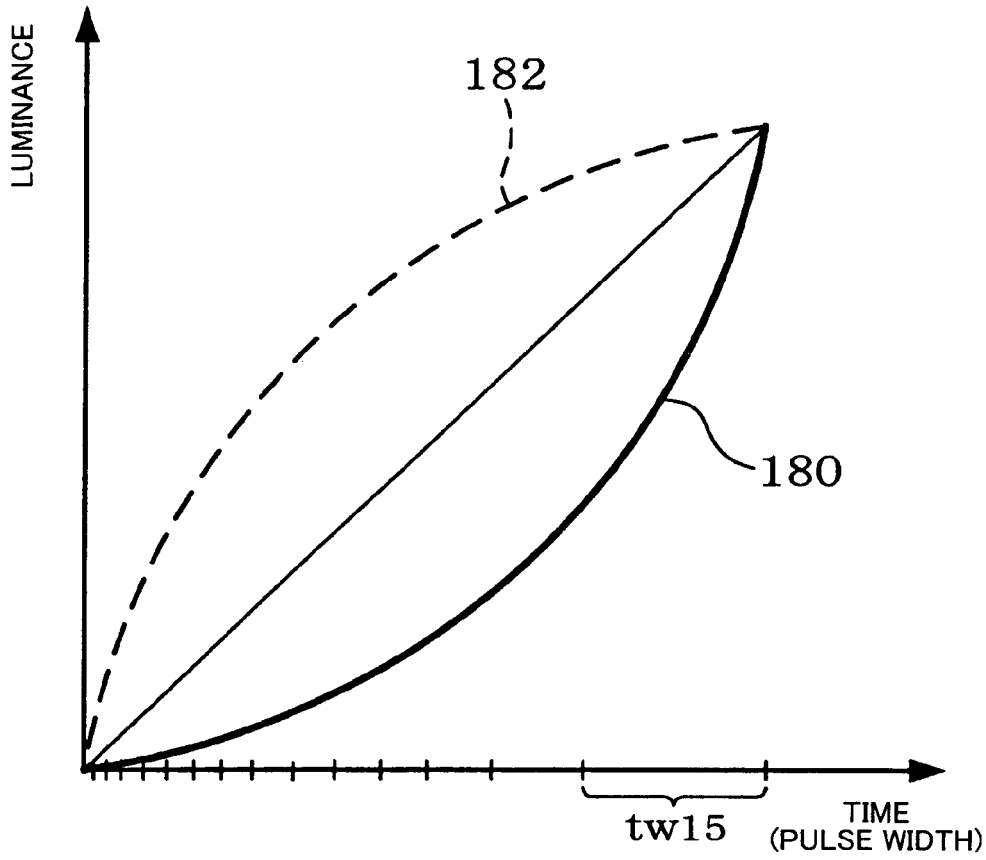
FIG. 10 is a diagram showing an example of grayscale characteristics of an organic EL.

As described above, since the driver signal generation section 22 can individually set the timing of the edge of each grayscale pulse of the grayscale clock signal GCLK for specifying the change point of the PWM signal, gamma correction which corrects a characteristic curve 180 of the organic EL panel 510 as shown in FIG. 10 is implemented, and the organic EL panel 510 can be finely controlled so that characteristics such as a gamma correction curve 182 are obtained. According to the characteristic diagram shown in FIG. 10, it is necessary to increase the interval between the grayscale pulses (pulse width of the grayscale clock signal) as the luminance is increased in order to obtain luminance (grayscale) specified by discrete grayscale data.

FIG. 8 illustrates the case where the GCLK generation section 100 generates only the grayscale clock signal GCLK. However, this embodiment is not limited thereto. The display controller 540 may include the grayscale clock generation section and the first to Nth grayscale pulse setting registers for each color component which makes up one pixel, and the interval between the reference timing and the first grayscale pulse and the interval between the edges of the grayscale pulses may be set for each color component based on the values set in the first to Nth grayscale pulse setting registers.

Figure 11:
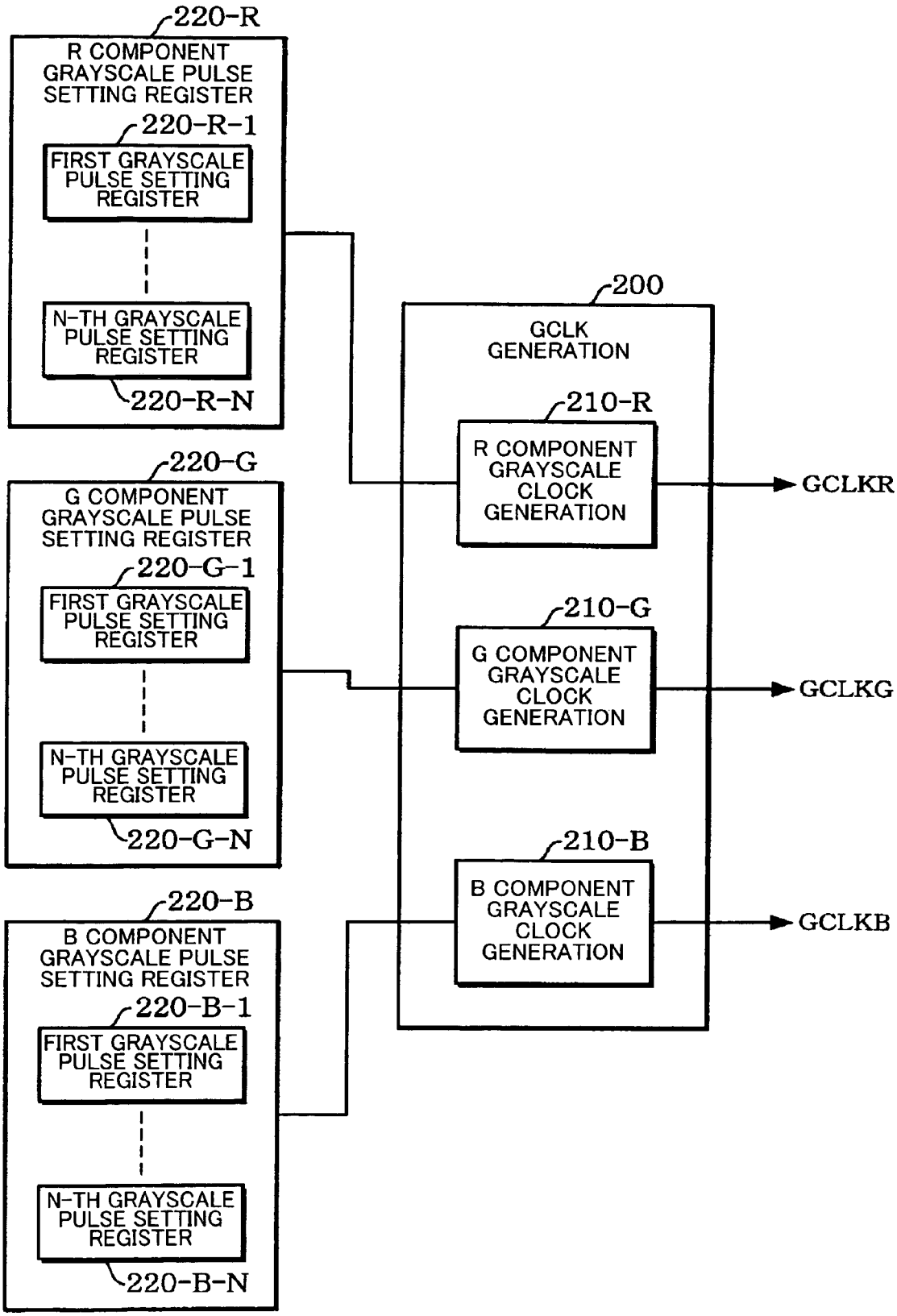
FIG. 11 is a block diagram showing a GCLK generation section when generating a grayscale clock signal for each color component.

FIG. 11 shows the GCLK generation section when generating the grayscale clock signal for each color component.

The GCLK generation section 200 includes an R component grayscale clock generation section 210-R, a G component grayscale clock generation section 210-G, and a B component grayscale clock generation section 210-B. The R component grayscale clock generation section 210-R outputs the grayscale clock signal in the same manner as the GCLK generation section 100 shown in FIG. 8. The R component grayscale clock generation section 210-R, the G component grayscale clock generation section 210-G, and the B component grayscale clock generation section 210-B have the same configuration. Since the display control signal generation section 110 of the driver signal generation section 22 is the same as in FIG. 8, illustration is omitted.

The setting register section 50 includes an R component grayscale pulse setting register 220-R, a G component grayscale pulse setting register 220-G, and a B component grayscale pulse setting register 220-B. The R component grayscale pulse setting register 220-R includes first to Nth grayscale pulse setting registers 220-R-1 to 220-R-N. The first to Nth grayscale pulse setting registers 220-R-1 to 220-R-N are the same as the first to Nth grayscale pulse setting registers 120-1 to 120-N shown in FIG. 8. The R component grayscale pulse setting register 220-R, the G component grayscale pulse setting register 220-G, and the B component grayscale pulse setting register 220-B have the same configuration.

The R component grayscale clock generation section 210-R outputs the grayscale clock signal GCLKR having N grayscale pulses from the reference timing as the starting point of the horizontal display period based on the value set in the R component grayscale pulse setting register 220-R. The G component grayscale clock generation section 210-G outputs the grayscale clock signal GCLKG having N grayscale pulses from the reference timing which is the starting point of the horizontal display period based on the value set in the G component grayscale pulse setting register 220-G. The B component grayscale clock generation section 210-B outputs the grayscale clock signal GCLKB having N grayscale pulses from the reference timing which is the starting point of the horizontal display period based on the value set in the B component grayscale pulse setting register 220-B.

Therefore, the grayscale clock signals GCLKR to GCLKB, of which the grayscale pulse interval can be set, can be generated for each color component, the pulse widths of the PWM signals are caused to differ even if the value of the grayscale data is the same. This enables a desired grayscale representation to be implemented by performing fine gamma correction for each color component, even if there is a significant difference in luminance between the color components.

Figure 12:
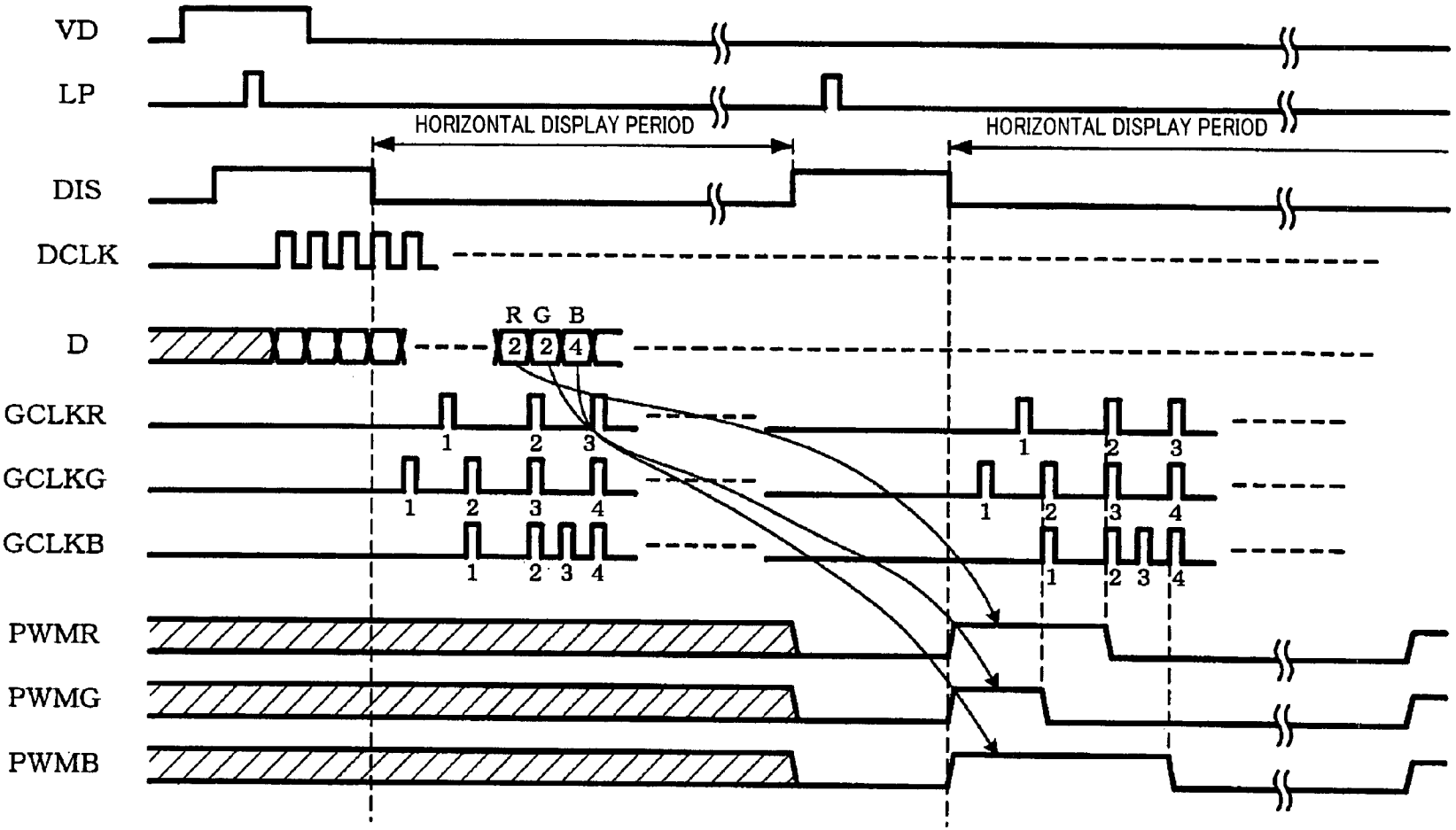
FIG. 12 is a timing chart of an operation for generating a PWM signal using the grayscale clock signal shown in FIG. 11.

FIG. 12 shows a timing chart of an operation for generating the PWM signal using the grayscale clock signals GCLKR to GCLKB shown in FIG. 11.

One vertical scan period starts when the pulse of the vertical synchronization signal VD is input from the display controller 540. One horizontal scan period starts when the pulse of the horizontal synchronization signal LP is input from the display controller 540 in a period in which the vertical synchronization signal VD is at the H level. The horizontal display period starts based on the timing at which the disable signal DIS from the display controller 540 changes from the H level to the L level as the reference timing. The horizontal display period ends at the timing at which the next disable signal DIS changes to the H level.

In the horizontal display period, the display controller 540 outputs the dot clock signal DCLK and sequentially outputs the color component grayscale data in synchronization with the dot clock signal DCLK. The GCLK generation section 200 shown in FIG. 11 outputs the grayscale clock signals GCLKR, GCLKG, and GCLKB within the horizontal display period based on the R component grayscale pulse setting register 220-R, the G component grayscale pulse setting register 220-G, and the B component grayscale pulse setting register 220-B.

The data driver 520 which has stored the grayscale data from the display controller 540 in the shift register 522 latches the grayscale data in one horizontal scan unit in the line latch 524 based on the horizontal synchronization signal LP in a period in which the disable signal DIS is at the H level. Therefore, the data driver 520 generates the PWM signals PWMR, PWMG, and PWMB corresponding to the grayscale data in the horizontal scan period subsequent to the horizontal scan period in which the grayscale data from the display controller 540 is supplied. In FIG. 12, since the R component grayscale data is "2", the pulse width of the PWM signal PWMR is the period from the falling edge of the disable signal DIS to the edge of the second grayscale pulse. Since the G component grayscale data is "2", the pulse width of the PWM signal PWMG is the period from the falling edge of the disable signal DIS to the edge of the second grayscale pulse. Since the B component grayscale data is "4", the pulse width of the PWM signal PWMG is the period from the falling edge of the disable signal DIS to the edge of the fourth grayscale pulse. As described above, since the interval between the grayscale pulses of the grayscale clock signal can be caused to differ for each color component, the PWM signals having different pulse widths can be generated for the color components whose grayscale data value is the same.

Moreover, the horizontal display period whose blanking period is adjusted by the disable signal DIS is variable, and the interval between the grayscale pulses can be caused to differ within the horizontal display period. This enables the pulse width of the PWM signal to be set as the absolute value corresponding to the size of the organic EL panel 510 and the type of the organic EL element, whereby a desired grayscale representation can be facilitated.

FIG. 12 illustrates the case where the interval between the reference timing and the grayscale pulse or the interval between the grayscale pulses is set at the rising edge of each grayscale pulse. However, the interval may be set at the falling edge of each grayscale pulse.

2.1 Detailed Configuration Example

A detailed configuration example of the GCLK generation section 200 shown in FIG. 11 is described below taking N=15 as an example.

Figure 13:
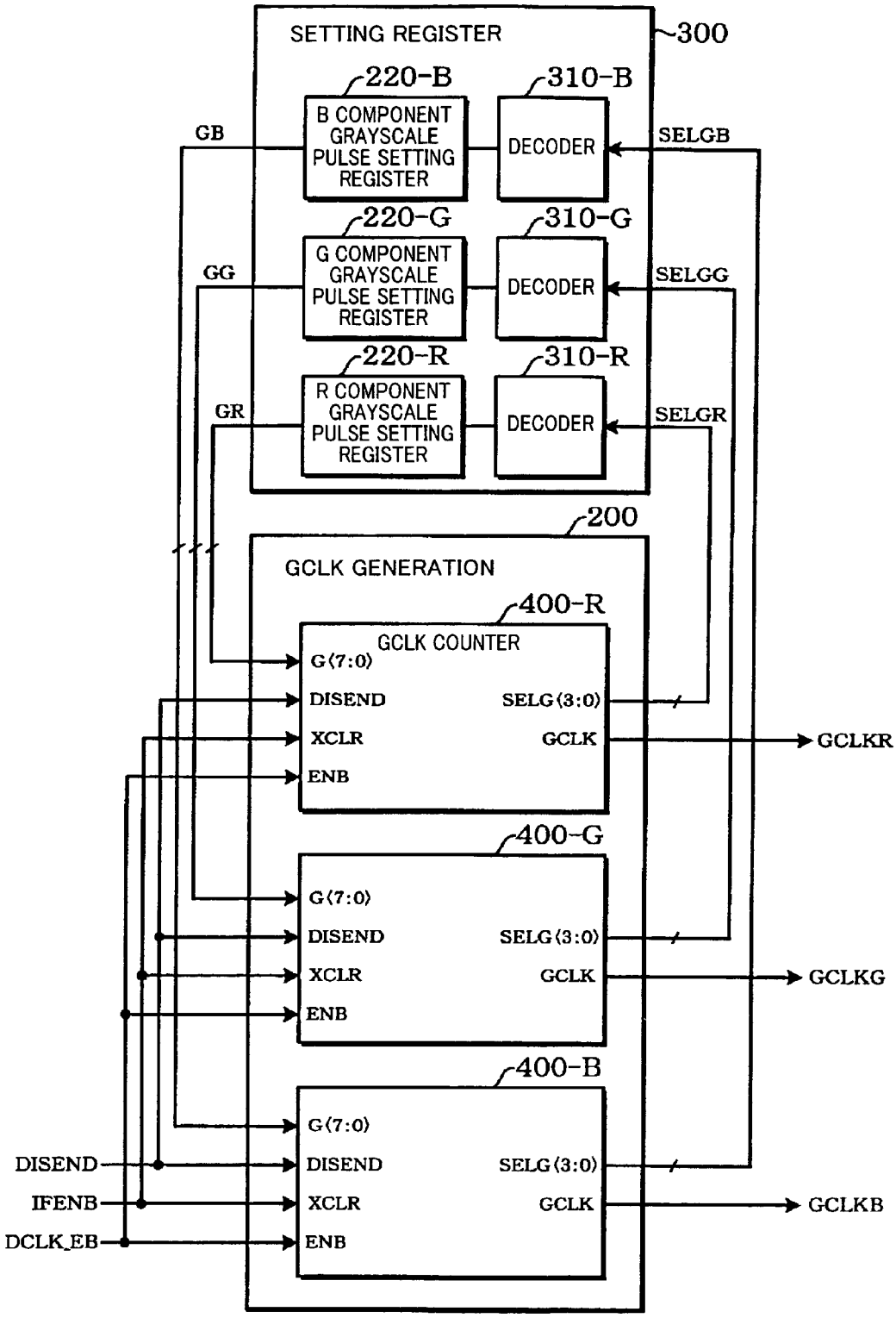
FIG. 13 is a block diagram showing the circuit configuration of a GCLK generation section.

FIG. 13 is a block diagram showing the circuit configuration of the GCLK generation section 200. A system clock signal SYSCLK (not shown) is input in common to each section of the GCLK generation section 200, and each section operates in synchronization with the system clock signal SYSCLK.

The GCLK generation section 200 includes a GCLK counter 400-R which functions as the R component grayscale clock generation section 210-R, a GCLK counter 400-G which functions as the G component grayscale clock generation section 210-G, and a GCLK counter 400-B which functions as the B component grayscale clock generation section 210-B. The GCLK counters 400-R to 400-B have the same configuration.

Setting data GR<7:0> stored in one of the first to fifteenth grayscale pulse setting registers 220-R-1 to 220-R-15 of the R component grayscale pulse setting register 220-R is input to the GCLK counter 400-R. A disable end signal DISEND which indicates the falling edge of the disable signal DIS, an IF enable signal IFENB which is an enable signal of the driver I/F 20, and a DCLK edge signal DCLK_EB which indicates the falling edge of the dot clock signal DCLK are input to the GCLK counter 400-R. The GCLK counter 400-R outputs the R component grayscale clock signal GCLKR and SELGR<3:0> for selecting the next grayscale pulse setting register.

The GCLK counters 400-G and 400-B are the same as the GCLK counter 400-R, to or from which the G component or B component signal is input or output instead of the R component signal. Therefore, further description is omitted.

Figure 14:
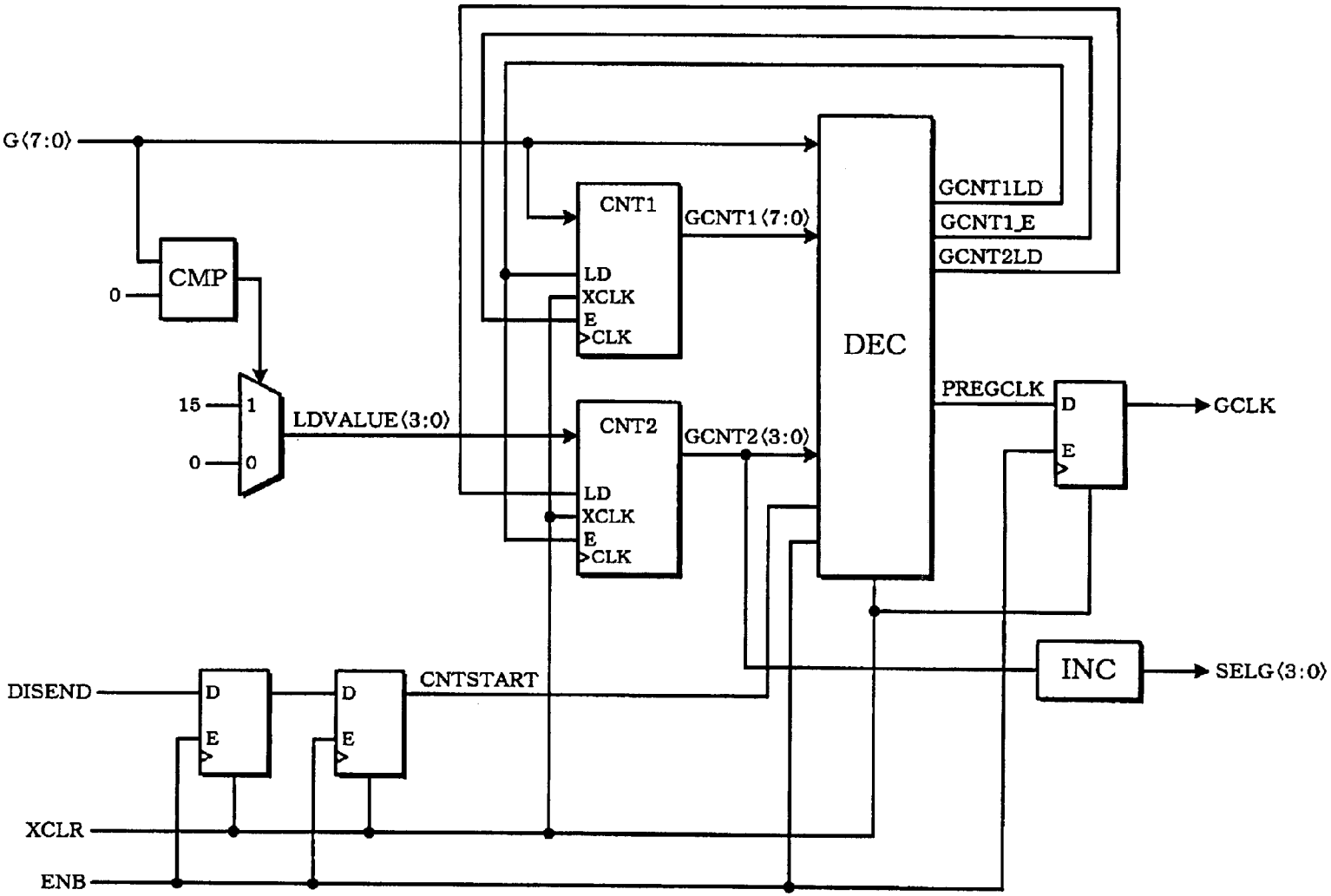
FIG. 14 is a block diagram showing the circuit configuration of a GCLK counter.

FIG. 14 is a block diagram showing the circuit configuration of the GCLK counter.

The GCLK counter shown in FIG. 14 has the same configuration as those of the GCLK counters 400-R, 400-G, and 400-B shown in FIG. 13. The system clock signal SYSCLK is input to each circuit section shown in FIG. 14, and the internal state is initialized by a clear signal XCLR.

The GCLK counter includes a pulse width counter CNT1 and a grayscale counter CNT2. The pulse width counter CNT1 counts the interval until the edge of the next grayscale pulse by decrementing setting data G<7:0>. Specifically, the pulse width counter CNT1 outputs the grayscale pulse so that the time at which the counter value becomes "0" by decrementing the setting data G<7:0> of the grayscale pulse setting register is the edge of the next grayscale pulse.

FIG. 15 shows a truth table for an operation of the pulse width counter CNT1.

FIG. 15 shows that the pulse width counter CNT1 operates in synchronization with the system clock signal SYSCLK (not shown) input to a CLK terminal. For example, when a load signal input to an LD terminal is at the H level (1), the setting data G<7:0> is loaded in synchronization with the rising edge of the system clock signal SYSCLK. For example, when the load signal is at the L level (0) and an enable signal input to an E terminal is at the H level, the pulse width counter CNT1 decrements a counter value GCNT1<7:0> in synchronization with the rising edge of the system clock signal SYSCLK.

In FIG. 14, the grayscale counter CNT2 is a counter for specifying the current grayscale pulse. Specifically, the grayscale counter CNT2 increments a counter value GCNT2<3:0> which is a pulse number for specifying the current grayscale pulse, and stops output of the grayscale pulse when the counter value GCNT2<3:0> becomes "15". The setting data in the pulse number decremented by the pulse width counter CNT1 is specified by the counter value GCNT2<3:0>.

FIG. 16 shows a truth table for an operation of the grayscale counter CNT2. FIG. 16 shows that the grayscale counter CNT2 operates in synchronization with the system clock signal SYSCLK (not shown) input to a CLK terminal. For example, when a load signal input to an LD terminal is at the H level (1), a load value LDVALUE<3:0> is loaded in synchronization with the rising edge of the system clock signal SYSCLK. For example, when the load signal is at the L level and an enable signal input to an E terminal is at the H level, the grayscale counter CNT2 increments a counter value GCNT2<3:0> in synchronization with the rising edge of the system clock signal SYSCLK.

The pulse width counter CNT1 and the grayscale counter CNT2 are enable-controlled and load-controlled by a decoder DEC.

The counter value GCNT1<7:0> from the pulse width counter CNT1, the counter value GCNT2<3:0> from the grayscale counter CNT2, the enable signal ENB, a count start signal CNTSTART, and the like are input to the decoder DEC. The decoder DEC outputs a pulse width counter load signal GCNT1LD, a pulse width counter enable signal GCNT1_E, a grayscale counter load signal GCNT2LD, and a pre-grayscale clock signal PREGCLK. The pulse width counter load signal GCNT1LD is supplied to the LD terminal of the pulse width counter CNT1 and the E terminal of the grayscale counter CNT2. The pulse width counter enable signal GCNT1_E is supplied to the E terminal of the pulse width counter CNT1. The grayscale counter load signal GCNT2LD is supplied to the LD terminal of the grayscale counter CNT2.

FIG. 17 shows a truth table for an operation of the decoder DEC. In FIG. 17, each signal indicated in the signal name field is set at the H level when the condition field is true.

When the count start signal CNTSTART is at the H level, or the counter value GCNT2 is not "15" and the counter value GCNT1 is "0", and the enable signal ENB is at the H level, the pulse width counter load signal GCNTLLD is set at the H level. In this case, the pulse width counter CNT1 loads the setting data G<7:0>, and the grayscale counter CNT2 increments the counter value GCNT2<3:0>.

When the counter value GCNT2 is not "15" and the enable signal ENB is at the H level, the pulse width counter enable signal GCNT1_E is set at the H level. In this case, the pulse width counter CNT1 decrements the counter value GCNT1<3:0>.

When the count start signal CNTSTART is at the H level, or the counter value GCNT1 is "0" and the setting data G<7:0> is "0", and the enable signal ENB is at the H level, the grayscale counter load signal GCNT2LD is set at the H level. In this case, the grayscale counter CNT2 loads the load value LDVALUE<3:0>.

When the counter value GCNT1<7:0> is "1", the pre-grayscale clock signal PREGCLK is set at the H level.

As described above, the decoder DEC updates the pulse width counter load signal GCNT1LD, the pulse width counter enable signal GCNT1_E, and the grayscale counter load signal GCNT2LD when the enable signal ENB is at the H level. Since the enable signal ENB of the decoder DEC is the DCLK edge signal DCLK_EB, the pulse width counter CNT1 is decremented in dot clock signal DCLK units. Specifically, the GCLK counter shown in FIG. 14 can output the grayscale clock signal GCLK whose edge position can be adjusted in dot clock signal DCLK units.

Figure 18:
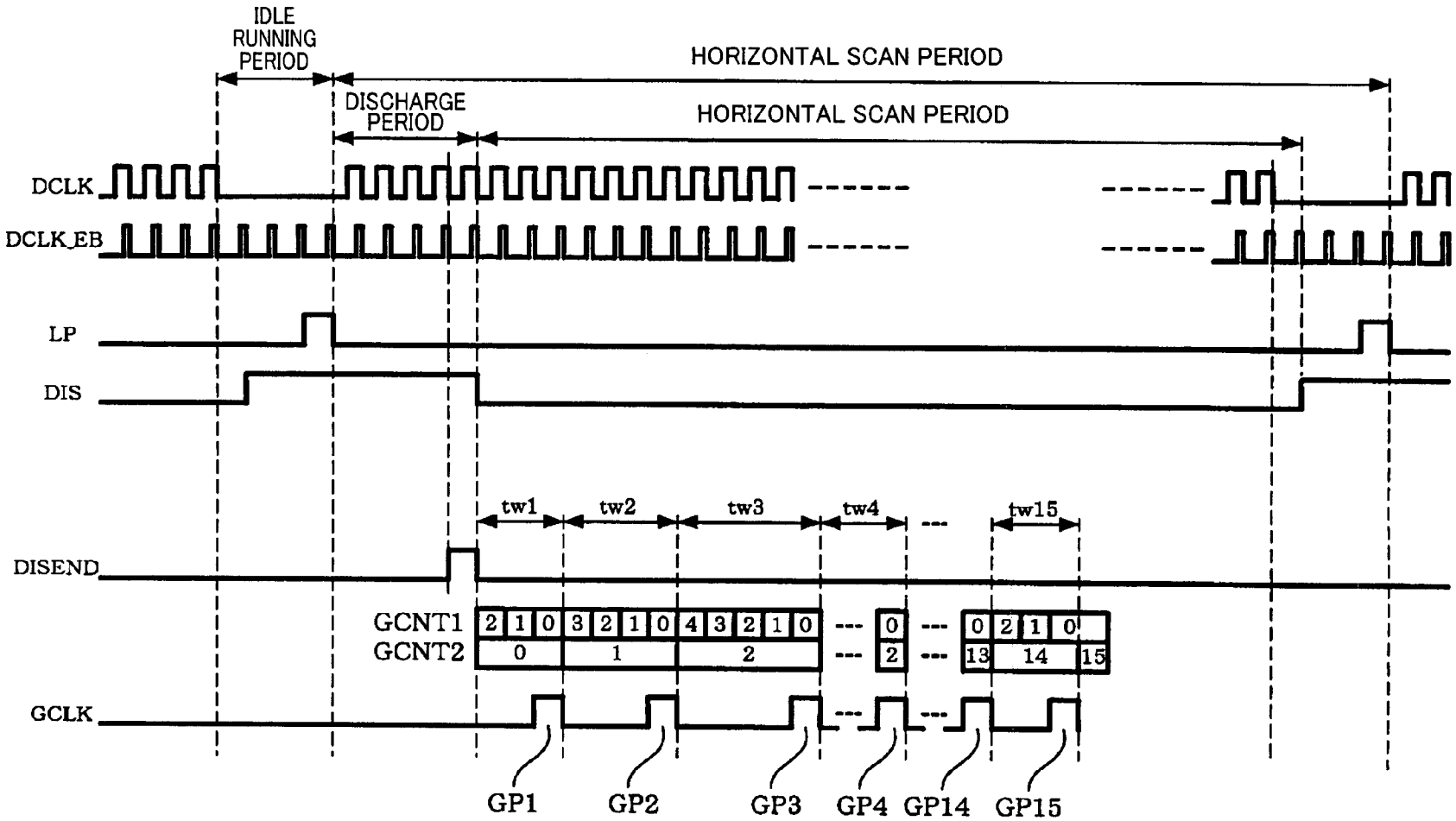
FIG. 18 is a timing chart of an operation of the GCLK generation section having the configuration shown in FIGS. 13 to 17.

FIG. 18 shows a timing chart of an operation of the GCLK generation section 200 having the configuration shown in FIGS. 13 to 17. In FIG. 18, the interval between the reference timing and the grayscale pulse or the interval between the grayscale pulses is set at the falling edge of each grayscale pulse.

In each GCLK counter, the count start signal CNTSTART is set at the H level when the disable end signal DISEND is set at the H level based on the falling edge of the disable signal DIS. The setting data G<7:0> stored in the first pulse width setting register is loaded into the pulse width counter CNT1. The pulse width counter CNT1 decrements the counter value GCNT1<7:0> when the DCLK edge signal DCLK_EB (enable signal ENB) is at the H level. When the counter value GCNT1<7:0> is "1", the decoder DEC sets the pre-grayscale clock signal PREGCLK at the H level.

The value set in the next second grayscale pulse setting register is loaded into the pulse width counter CNT1 and the grayscale counter CNT2 increments the counter value GCNT2<3:0> on condition that the counter value GCNT1<7:0> has become "0".

The pre-grayscale clock signal PREGCLK is retimed by a retiming circuit and output as the grayscale clock signal GCLK.

The counter value GCNT2<3:0> is incremented by an incrementer INC and supplied to the setting register section 300 as SELG<3:0>. In FIG. 13, the setting register section 300 receives SELG<3:0> (SELGR<3:0>, for example) from the GCLK counter (GCLK counter 400-R, for example), analyzes the grayscale pulse setting register specified by SELG<3:0> using the decoder (decoder 310-R, for example), and returns the setting data of the grayscale pulse setting register to the GCLK counter (GCLK counter 400-R, for example) as G<7:0> (GR<7:0>, for example).

The GCLK counter performs the above-described operation in units of one horizontal scan period.

In the GCLK counter, the output from the comparator CMP is set at the H level when the setting data G<7:0> is "0". When the output from the comparator CMP is at the H level, the load value LDVALUE<3:0> becomes "15". Therefore, the grayscale counter CNT2 stops output of the subsequent grayscale pulse. Specifically, when the value set in the pth ($1 \leqq p \leqq N-1$, p is an integer) grayscale pulse setting register is a predetermined value ("0", for example), generation of the (p+1)th to Nth grayscale pulses is omitted.

Figure 19:
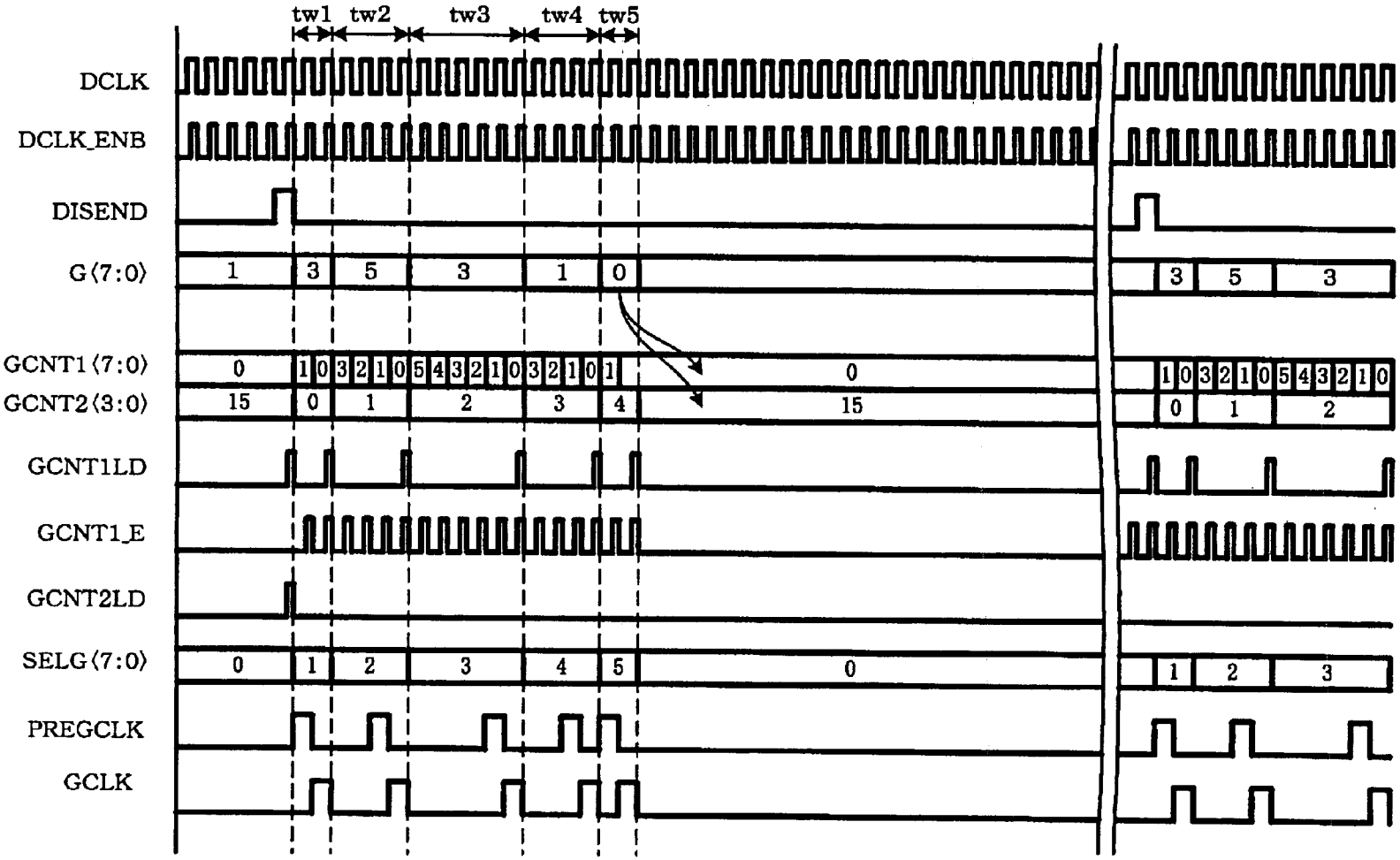
FIG. 19 is a timing chart of an operation when output of the grayscale pulse is omitted.

FIG. 19 is a timing chart of an operation when the output of the grayscale pulse is omitted.

FIG. 19 shows an operation example when the value set in the fifth grayscale pulse setting register is set at "0". Specifically, since the value set in the fifth grayscale pulse setting register is "0" when the counter value GCNT2<3:0> is "4", output of the sixth to fifteenth grayscale pulses is omitted. This enables this embodiment to be easily applied to the case where it suffices that the number of grayscale levels be smaller.

Although only some embodiments of the present invention have been described in detail above, those skilled in the art will readily appreciate that many modifications are possible in the embodiments without departing from the novel teachings and advantages of this invention. Accordingly, all such modifications are intended to be included within the scope of this invention.

For example, the present invention may be applied not only to drive the above-described organic EL panel, but also to drive another electroluminescence panel, a liquid crystal display panel, or a plasma display device.

Part of requirements of any claim of the present invention could be omitted from a dependent claim which depends on that claim. Moreover, part of requirements of any independent claim of the present invention could be made to depend on any other independent claim.

What is claimed is:

1. A display controller comprising:

a grayscale clock generation section that generates a grayscale clock signal including N continuous grayscale pulses from a first grayscale pulse to an Nth grayscale pulse within a predetermined period starting from a reference timing, N being an integer greater than three; and a plurality of grayscale pulse setting registers, a first grayscale pulse setting register of the plurality of grayscale pulse setting registers setting an interval between the reference timing and a rising edge or falling edge of the first grayscale pulse of the N continuous grayscale pulses, an (i)th grayscale setting register of the plurality of grayscale setting registers setting an interval between a rising edge or a falling edge of an (i−1)th grayscale pulse of the N continuous grayscale pulses and a rising edge or a falling edge of an (i)th grayscale pulse of the N continuous grayscale pulses, the (i)th grayscale pulse following the (i−1)th grayscale pulse, i being an integer ranging from 2 to N, the reference timing being a falling edge of a disable signal that specifies a horizontal display period, the horizontal display period being a period that starts at the falling edge of the disable signal and ends at a rising edge of a next disable signal, the grayscale clock generation section supplying the grayscale clock signal to a data driver, the data driver generating a pulse width modulated signal having a pulse width that is determined based on a number of pulses of the grayscale clock signal corresponding to grayscale data, and the data driver drives a plurality of data lines based on the pulse width modulated signal.

2. The display controller as defined in claim 1, further comprising:

a blanking adjustment signal generation section that generates a blanking adjustment signal for setting a blanking period in which a pulse of a horizontal synchronization signal is output, the predetermined period starting from a change timing of the blanking adjustment signal, and the predetermined period ending at a next change timing of the blanking adjustment signal.

3. A display system comprising:

a display panel the display controller as defined in claim 2;

a scan driver that scans a plurality of scan lines; and the data driver that drives the plurality of data lines based on the pulse width modulated signal, the display panel including the plurality of scan lines, the plurality of data lines and a plurality of electroluminescence elements, and each of the electroluminescence elements being specified by one of the plurality of scan lines and one of the plurality of data lines.

4. The display controller as defined in claim 1, the grayscale clock generation section and the plurality of grayscale pulse setting registers being provided for each color component that makes up one pixel, the grayscale clock generation section for each color component generating the grayscale clock signal for each color component, the plurality of grayscale pulse setting registers for each color component setting the interval between the reference timing and the rising edge or the falling edge of the first grayscale pulse for each color component and the interval between the rising edge or the falling edge of the (i−1)th grayscale pulse and the rising edge or the falling edge of the (i)th grayscale pulse for each color component, the grayscale clock generation section supplying the grayscale clock signal for each color component to the data driver, and the grayscale clock signal for each color component specifying the pulse width of the pulse width modulated signal for each color component.

5. A display system comprising:

a display panel the display controller as define din claim 4;

a scan driver that scans a plurality of scan lines;

the data driver that drives the plurality of data lines based on the pulse width modulated signal for each color component, the data driver generating the pulse width modulated signal having the pulse width for each color component that is determined based on the number of pulses of the gray scale clock signal for each color component corresponding to gray scale data for each color component, and the display panel including the plurality of scan lines, the plurality of data lines and a plurality of electroluminescence elements, and each of the electroluminescence elements being specified by one of the plurality of scan lines and one of the plurality of data lines.

6. The display controller as defined in claim 1, the grayscale clock generation section omitting generation of the (p+1)th grayscale pulse to the Nth grayscale pulse when a value set in a pth grayscale pulse setting register is a predetermined value, p being an integer ranging from 1 to N−1.

7. A display system comprising:

a display panel the display controller as defined in claim 6, a scan driver that scans a plurality of scan lines;

the data driver that drives the plurality of data lines based on the pulse width modulated signal, the display panel including the plurality of scan lines, the plurality of data lines and a plurality of electroluminescence elements, and each of the electroluminescence elements being specified by one of the plurality of scan lines and one of the plurality of data lines.

8. A display system comprising:

a display panel the display controller as defined in claim 1;

a scan driver that scans a plurality of scan lines; and the data driver that drives the plurality of data lines based on the pulse width modulated signal, the display panel including the plurality of scan lines, the plurality of data lines and a plurality of electroluminescence elements, and each of the electroluminescence elements being specified by one of the plurality of scan lines and one of the plurality of data lines.

9. A display control method comprising:

individually setting a plurality of periods, a first period of the plurality of periods being set from a reference timing to a rising or falling edge of a first grayscale pulse of N continuous grayscale pulses, an (i)th period of the plurality of periods being set from a rising edge or a falling edge of an (i−1)th grayscale pulse of the N continuous grayscale pulses to a rising edge or a falling edge of an (i)th grayscale pulse of the N continuous grayscale pulses, the (i)th grayscale pulse following the (i−1) the grayscale pulse, i being an integer ranging from 2 to N, N being an integer greater than three;

generating a grayscale clock signal having the N continuous grayscale pulses from the first grayscale pulse to the Nth grayscale pulse within a predetermined period starting from the reference timing;

generating a pulse width modulated signal having a pulse width that is determined based on a number of pulses of the grayscale clock signal corresponding to grayscale data; and driving a data line of a display panel based on the pulse width modulated signal, the reference timing being a falling edge of a disable signal that specifies a horizontal display period, and the horizontal display period being a period that starts at the falling edge of the disable signal and ends at a rising edge of a next disable signal.

10. The display control method as defined in claim 9, the predetermined period starting from a change timing of a blanking adjustment signal for setting a blanking period in which a pulse of a horizontal synchronization signal is output, and the predetermined period ending at a next change timing of the blanking adjustment signal.

11. The display control method as defined in claim 9, the grayscale clock signal being generated for each color component that makes up one pixel, and the pulse width modulated signal being generated for each color component.

12. The display control method as defined in claim 9, generation of the (p+1)th grayscale pulse to the Nth grayscale pulse being omitted when a value set in the pth grayscale pulse setting register is a predetermined value, p being an integer ranging from 1 to N−1.

* * * * *